United States Patent [19]

Kashiwara et al.

[11] Patent Number: 5,007,389

[45] Date of Patent: Apr. 16, 1991

[54] IGNITION PLUG FOR INTERNAL COMBUSTION ENGINES AND A PROCESS FOR IGNITING GAS MIXTURE BY THE USE THEREOF

[76] Inventors: Ryohei Kashiwara, Raitsu Ootori 106, 456-1, Ootori-kitamachi 8-cho, Sakai-shi, Osaka-fu; Hideaki Kashiwara, 3-B, 611, 151-30, Ninomaru-cho, Mukojima, Fushimi-ku, Kyoto-shi; Hidehiko Noguchi, 7-14, Taiho 3-chome, Kanan-cho, Minami-kawachi-gun, Osaka-fu; Takeaki Kashiwara, 3,37-411, Nagayoshidedo 3-chome, Hirano-ku, Osaka-shi, all of Japan

[21] Appl. No.: 268,788

[22] Filed: Nov. 9, 1988

[30] Foreign Application Priority Data

Dec. 17, 1987 [JP] Japan ..... 62-321045
Sep. 30, 1988 [JP] Japan ..... 63-248394

[51] Int. Cl.[5] ..... F02P 1/00; H01T 13/20

[52] U.S. Cl. ..... 123/169 MG; 123/169 EL; 313/139; 313/141

[58] Field of Search ..... 123/169 MG, 310, 169 R, 123/169 EL, 169 G; 313/139, 141, 142

[56] References Cited

U.S. PATENT DOCUMENTS

| | | | |
|---|---|---|---|
| 1,243,205 | 10/1917 | Norman | 123/169 MG |
| 1,298,368 | 3/1919 | Matzinger | 123/169 MG |
| 1,360,294 | 11/1920 | Hill | 113/141 |
| 1,371,488 | 3/1921 | Jacobson | 313/141 |
| 1,644,633 | 10/1927 | Buckingham | 123/169 MG |
| 1,943,674 | 1/1934 | Wards-Humphery | 123/169 MG |
| 2,129,003 | 9/1938 | Grant | 123/169 |
| 2,217,825 | 10/1940 | Twining et al. | 123/169 EL |
| 2,246,946 | 6/1941 | McCarty et al. | 123/169 EL |
| 2,391,459 | 12/1945 | Hensel | 123/169 |
| 2,616,407 | 11/1952 | Thomas | 123/169 |
| 2,944,178 | 7/1960 | Schaub | 313/141 |
| 3,313,972 | 4/1967 | Beesch | 313/130 |
| 3,710,772 | 1/1973 | Warner | 123/169 R |
| 3,908,625 | 9/1975 | Roony | 123/169 R |
| 3,921,020 | 11/1975 | Wax | 123/169 EL |
| 3,970,885 | 7/1976 | Kasima | 313/141 |
| 4,023,058 | 5/1977 | Lara et al. | 313/139 |
| 4,123,998 | 11/1978 | Heintzelman | 123/32 |
| 4,164,912 | 8/1979 | Bayler | 123/169 MG |
| 4,401,915 | 8/1983 | Kashiwara et al. | 313/142 |
| 4,808,878 | 2/1989 | Kashiwara et al. | 313/141 |

FOREIGN PATENT DOCUMENTS

| | | | |
|---|---|---|---|
| 2479588 | 10/1981 | France | 123/169 EL |
| 53-25743 | 3/1978 | Japan . | |
| 53-54778 | 5/1978 | Japan . | |
| 53-87331 | 8/1978 | Japan . | |
| 53-121107 | 10/1978 | Japan . | |
| 117948 | 9/1979 | Japan | 123/169 EL |
| 146001 | 11/1979 | Japan | 123/169 EL |
| 13755 | 1/1980 | Japan | 123/169 EL |
| 46481 | 4/1980 | Japan | 123/169 EL |
| 61-30394 | 2/1986 | Japan . | |
| 30394 | 7/1986 | Japan | 123/169 EL |
| 187501 | 10/1922 | United Kingdom . | |

*Primary Examiner*—Raymond A. Nelli
*Attorney, Agent, or Firm*—Fisher, Christen & Sabol

[57] ABSTRACT

This invention concerns an ignition plug for internal combustion engines and a process for igniting gas mixture by the use thereof, which functionally speaking are characterized by utilizing the expansion of initial gas combustion following the formation of primary ignited gasses in a spark gap for the formation of secondary ignited gasses and the completion of combustion over the entire space of the ignition plug. For this, either the inside surface of a ground electrode opposed to a center electrode of the side surface of a center electrode opposed to a ground electrode is made flat in principle in order to drive primary ignited gasses from a spark gap to an ignition groove, which is to be provided to on the top of a center electrode or the other side of a ground electrode as to a center electrode, by the use of the initial combustion explosion in the spark gap so as to accelerate the growth and the multiplication of the ignited gasses there and lead them to complete instantaneous combustion.

19 Claims, 14 Drawing Sheets

FIG. 8
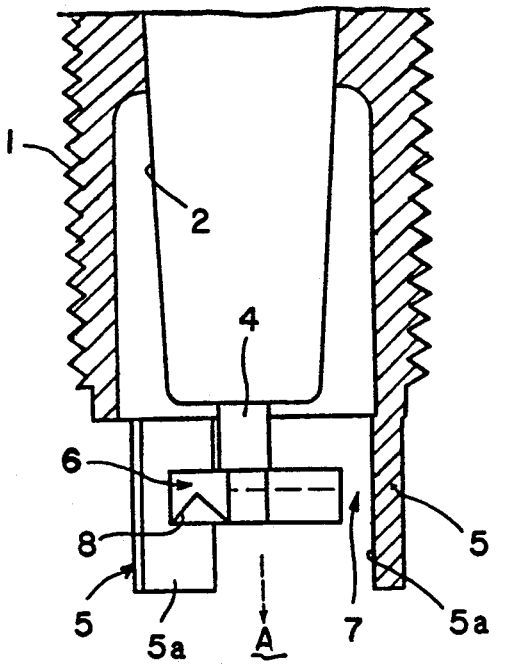
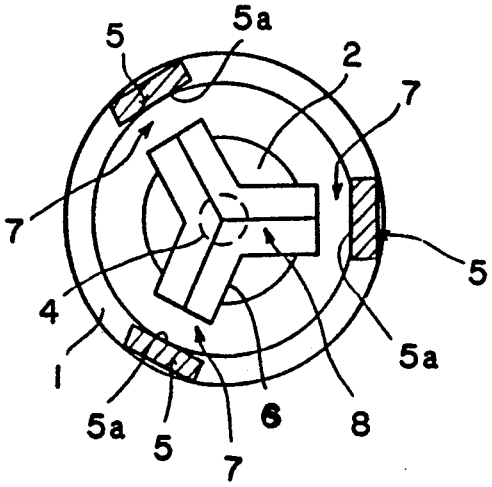
FIG. 9
FIG. 10
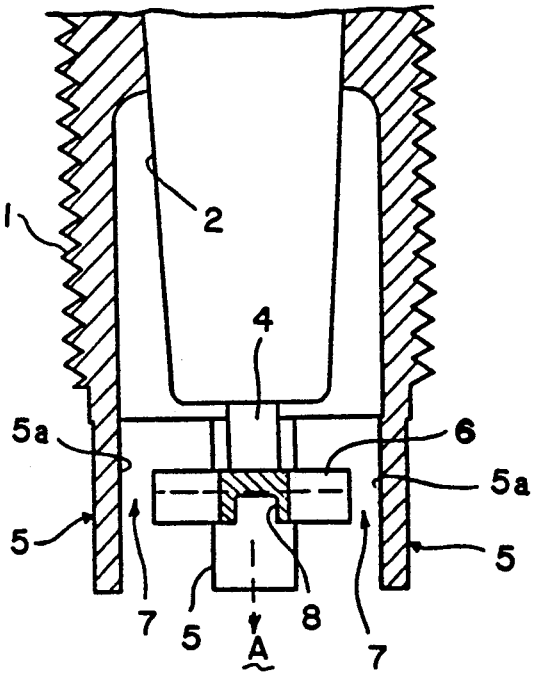
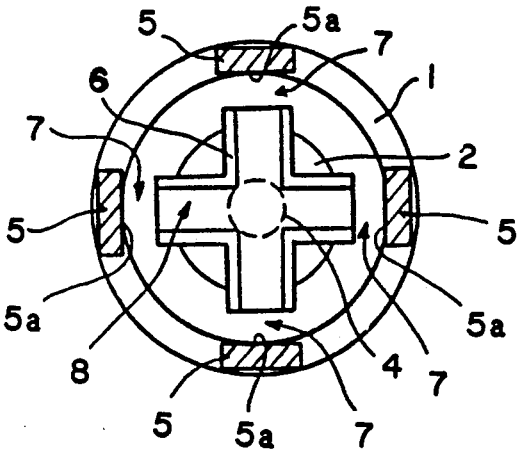
FIG. 11

IGNITION PLUG FOR INTERNAL COMBUSTION ENGINES AND A PROCESS FOR IGNITING GAS MIXTURE BY THE USE THEREOF

This invention concerns an ignition plug for internal combustion engines to cause instantaneous combustion and a process for igniting gas mixture by the use thereof.

As disclosed in Japanese patent application publication No. sho 62-11471, there has so far been developed an art that provides an ignition groove to the other side of an L-shaped ground electrode as to a center electrode in order for a small amount of gas mixture staying in the groove to be ignited first so that earlier combustion there may cause complete combustion of the gases in a groove of the ignition plug. However, in the ignition plug the end of the ignition groove opens toward such a cylindrical center electrode that ignited gases first appearing in a spark gap strike on the cylindrical surface of the center electrode by expanding combustion gas and have to radiantly bounce thereon; thus, they become less densed in the outward direction, which consequently makes it less effective to strike gas mixture in the groove to ignite.

Under the circumstances, the present inventors made intensive studies to eliminate drawbacks in the prior art and finally accomplished the invention, finding the fact that combustion can be made certain by the ignited gases first appearing in a spark gap striking the flat surface of ground electrodes or the flat surface of center electrode taking advantage of the rapidly expanding force of combustion gas, and guiding successively forming ignition seeds to an ignition groove provided on a rod-type ignition member mounted on the top of center electrode, on the flat surface of center and/or ground electrodes, or the other side of an L-shaped ground electrode as to center electrode so as to ignite gas mixture in the groove.

That is, an ignition plug according to this invention is characterized in that an ignition member for accelerating ignition is mounted on the top of the center electrode, the surface of the ignition member facing toward the piston side is provided with an ignition groove, and at least one piece of ground electrode is disposed near the center electrode in such a way that the ground electrode stands on the extended longitudinal line of the ignition groove. The other is characterized in that the side surface of a center electrode opposed to a ground electrode is made flat, the outside surface of the ground electrode is provided with an ignition groove, and the end of the ground electrode where the ignition groove opens is opposed to the flat side surface of the center electrode.

It is an object of this invention to provide an ignition plug of which the structure is as simple as possible to be suitable for commercial production. It is another object of this invention to provide an ignition plug of which the ignition power for gas mixture is improved greatly compared with conventional ones. It is still another object of this invention to provide an ignition plug by which the ignition propagation speed of gas mixture can be increased so greatly as to widely reduce the time from the formation of ignited gas in a spark gap to the completion of combustion over the entire space of the ignition plug.

The above and other objects and features of this invention will appear more fully hereinafter from a consideration of the following description taken in connection with the accompanying drawings, in which:

FIGS. 8 and 9 are elevational view and a bottom view of the third example of an ignition plug of this invention.

FIGS. 10 and 11 are an elevational view and a bottom view of the fourth example of an ignition plug of this invention.

In order that this invention may be understood more clearly, reference will now be made to a variety of embodiment of this invention.

Figure 1:
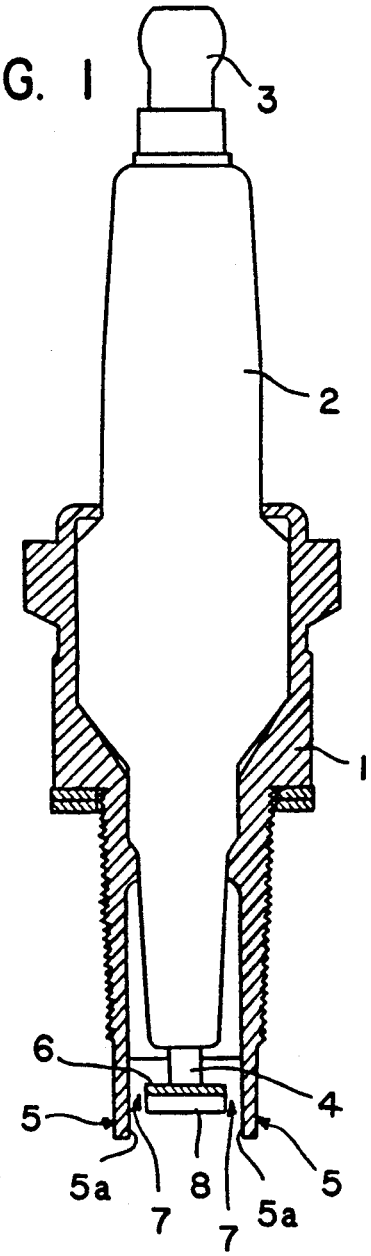
FIG. 1 is an entire elevational view of an ignition plug of which the lower end to be put in the engine block is provided with center and straight ground electrodes of the first example of this invention.
Figure 2:
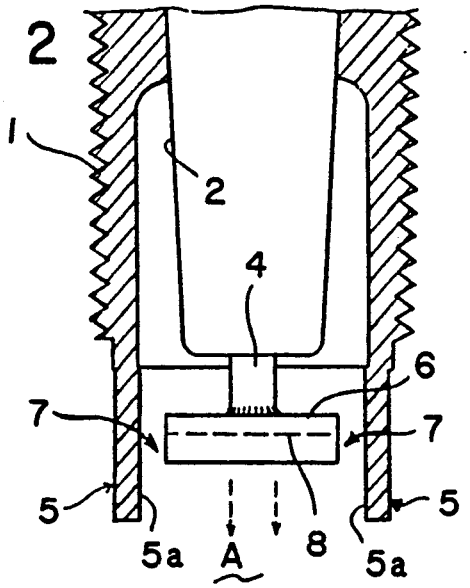
FIGS. 2 through 4 are an elevational, a side view, and a bottom view of the first example of an ignition plug of this invention. (Like this, hereinafter in the figures, every example of this invention will be shown in detail, restricted to only their essential head portions.)
Figure 3:
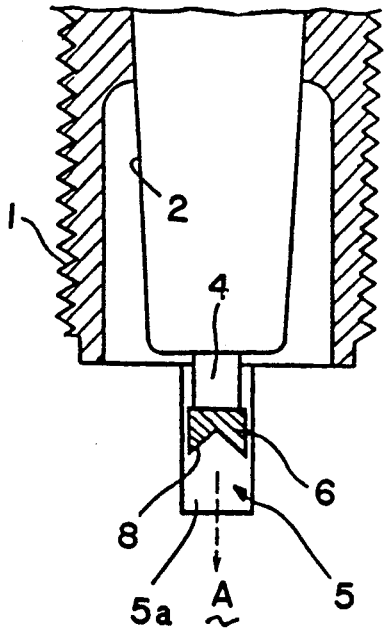
Figure 4:
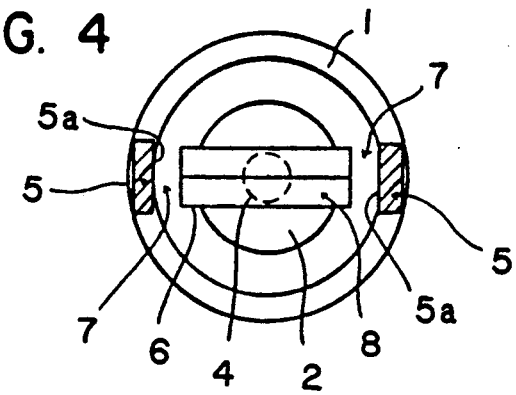

FIG. 1 shows the entire elevational view of an ignition plug, which includes the first example of an ignition plug of this invention, which is also shown in FIGS. 2, 3, and 4. As shown in FIGS. 1 through 4, electroconductive metal casing 1 of which the top forms a pair of straight ground electrodes 5, 5 and is put in a combustion chamber of the ignition plug in a secured manner with thread around the body, covers an insulating ceramic body 2, containing a lead connecting a terminal 3 to a center electrode 4, in such a way that both the center and the ground electrodes are electrically separated from each other. The straight, parallel ground electrodes 5, 5 are disposed on both sides of the center electrodes 4 so as to be parallel to the center electrode as well. The top of the center electrode 4 is provided with a rod-type ignition member 6 in one piece, for example by welding, at right angles to each other. A spark gap is thus formed between the flat inside surface 5*a* of the ground electrodes 5 and the end of the ignition member 6 respectively.

An ignition groove 8 with V-shaped cross-section, which is open toward the piston side A, and of which the angle approximately lies between 100° and 120° is provided to on top of the rod type ignition member 6 in the longitudinal direction thereof. The ignition groove 8 on the ignition member 6 of the center electrode 4 is located as to the ground electrodes 5, 5 in such a way that both the flat inside surfaces 5*a* of the ground electrodes 5, 5 face to each other with the ignition groove 8 in between, just like blocking the ignition groove.

The first example of this invention is constructed such that when high voltage is applied between the center and ground electrodes via the terminal 3, there form sparks in the gap 7. At this moment, gas mixture ignites immediately before the top dead point, and completes combustion, whereby a piston (not shown here) is instantly pushed back to the original position.

In each of these combustion cycles, firstly there appear ignited gas in the spark gap 7, which set gas mixture on fire in the ignition groove the space of which is much more restricted and narrow compared with anywhere else inside the ignition plug. Second ignited gas thus formed, larger than the first ones, take fire and explode in a moment in the groove 8. Expanding combustion gas bounces on the groove and gets expelled to the entire space of the ignition plug, which reduces the time necessary for the entire gas mixture to take fire in the cylinder, avoids uncomplete combustion, and alleviates the output loss in the piston's compression cycles in such a way as to cut down on the fuel consumption.

The first ignited gases in the spark gap when their expanding combustion force strikes on the inside surface of the ground electrodes 5, and drives successively forming ignited gases on to the ignition groove 8 of the center electrode 4 by repulsion, where there form second ignited gases, and they quickly ignite. This propagation mechanism of ignited gases not only accelerates the combustion of second ignited gases but also strengthens their combustion propagation into the entire space of the ignition plug.

Figure 5:
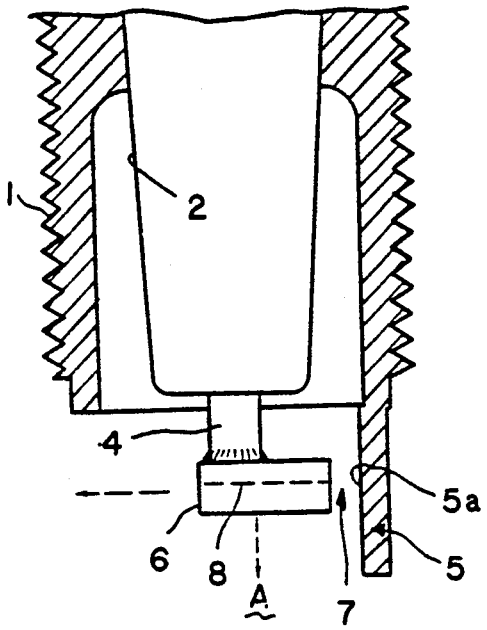
FIGS. 5 through 7 are elevational view, a side view, and a bottom view of the second example of an ignition plug of this invention.
Figure 6:
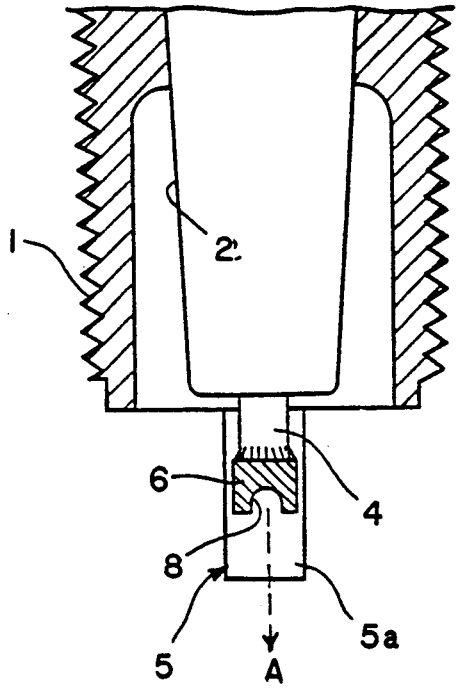
Figure 7:
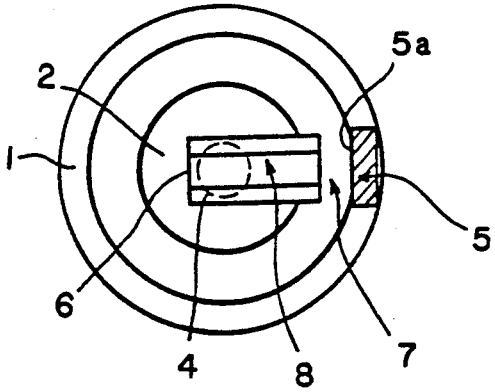

FIGS. 5 through 7 show the second example of an ignition plug of this invention. Unlike the first example, a rod-type ignition member 6 with an ignition groove 8 on the top of the center electrode 4 is combined with a single straight ground electrode 5; therefore, between the ignition rod 6 and the ground electrode 5 is the sole spark gap 7, as shown in FIGS. 5 and 7. The ignition groove 8 has a semicircular cross-section, which is open toward the piston side A.

The arrangement of the ignition rod 6 and the ground electrode 5 is such that when there appear first ignited gases in the spark gap 7, they travel to the nearby end of the ignition rod 6 by the help of the repulsion caused by explosive combustion on the inside surface 5*a* of the ground electrode 5 and forms second ignited gases in succession in the groove 8, whereby gas mixture is set on fire, not only on the other side of the spark gap but also on the piston side A extending the whole space of the ignition plug, as shown by an arrow-headed dotted line in FIGS. 5 and 6.

In order that the superiority of this invention may be understood clearly, the result of a running test of the same car made on the same course, equipped with an ordinary marketed ignition plug of which a ground electrode is bent ahead of a center electrode in an L-form and an ignition plug making use of the center and the ground electrodes in FIGS. 5 through 7 will be given in the following table.

| | Fuel consumption per 114 km | Coverable distance with 1 l of fuel |
|---|---|---|
| A. Ordinary type ignition plug | 16.1 l | 7.0 km (= 100) |
| B. Ignition plug of the invention | 12.8 l | 8.9 km (= 127) |

FIGS. 8 and 9 show the third example of an ignition plug of this invention. A Y-shaped ignition member 6 each arm of which is radially spaced at an angular interval of about 120° as to a center electrode 4 is mounted on the top of the center electrode. Their top is notched into a V-shape respectively so that there forms a junction of three ignition grooves 8 on the center facing toward the piston side A. Three pieces of ground electrodes 5, extended portions of the metal casing 1, are disposed on the same circumference around the center electrode 4 so that their flat inside surface 5*a* is opposed to the end of the ignition member respectively with a spark gap 7 in between.

FIGS. 10 and 11 show the fourth example of an ignition plug of this invention. A cruciform ignition member 6 each arm of which is radially spaced at 90° as to a center electrode 4 is mounted on the top of the center electrode. Their top is notched into a rectangular shape respectively so that there forms a junction of four ignition grooves 8 on the center facing toward the piston side A. Four pieces of ground electrodes 5, extended portions of the metal casing 1, are disposed on the same circumference around the center electrode 4 so that their inside surface 5*a* is opposed to the end of the ignition member 6 respectively with a spark gap 7 in between.

Figure 12:
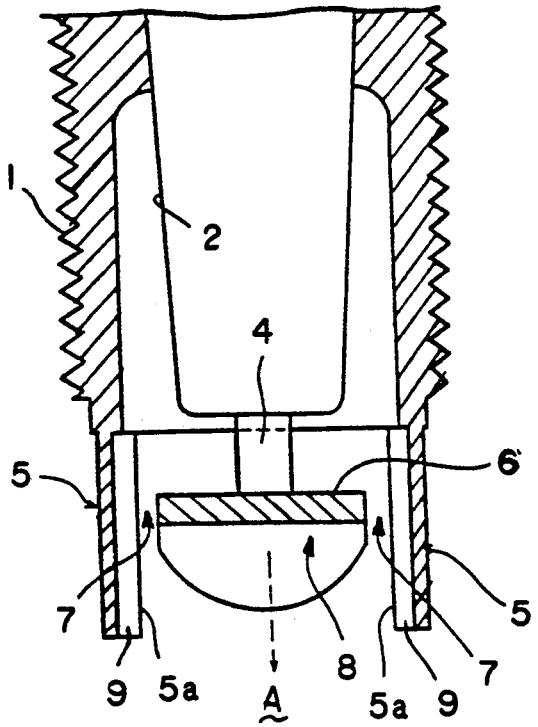
FIGS. 12 through 14 are an elevational view, a side view and a bottom view of the fifth example of an ignition plug of this invention.
Figure 13:
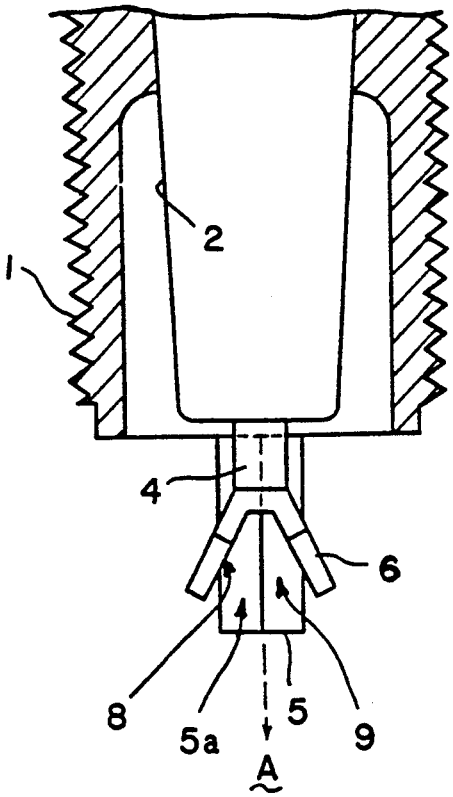
Figure 14:
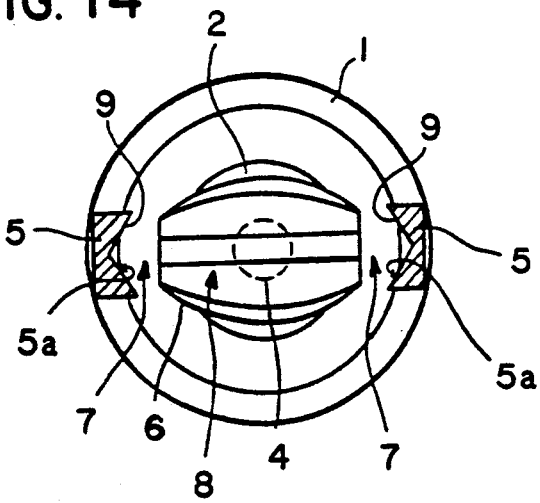

FIGS. 12 through 14 show the fifth example of an ignition plug of this invention. A saddle roof form ignition member 6 of which the skirt is semicircular, and of which the re-entrant cavity 8 is open toward the piston side A is mounted on the top of a center electrode 4. A pair of ground electrodes of which the inside surface 5*a* is notched into a V-shaped groove 9 respectively are disposed on the longitudinal sides of the saddle-type ignition member 6 with a spark gap 7 in between.

In this ignition plug, ignited gas first appearing in the spark gap 7 strike on the inside surface 5*a* of the ground electrodes 5 by the initial local combustion in such a way as to jump into the re-entrant cavity 8 of which the capacity to hold gas mixture proportionally increases from the end to the center. Second ignited gases thus appearing in the re-entrant cavity 8 cause combustion there, which instantaneously spreads out over the entire space of the ignition plug from the skirt of the saddle-type ignition member 6 opening toward the piston side A. In this example, the capacity of the cavity 8 is made far greater than those in the preceding examples, so that this type of ignition plug is rather suitable for the propane gas combustion.

Figure 15:
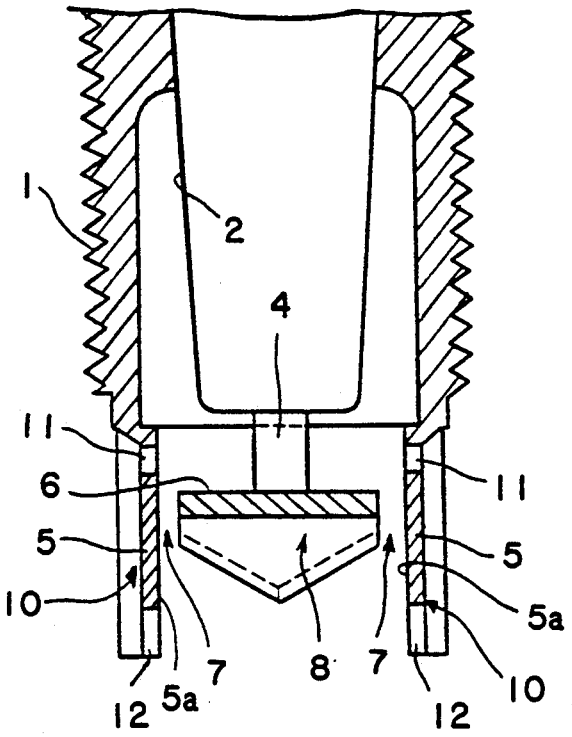
FIGS. 15 through 17 are an elevational view, a side view, and a bottom view of the sixth example of an ignition plug of this invention.
Figure 16:
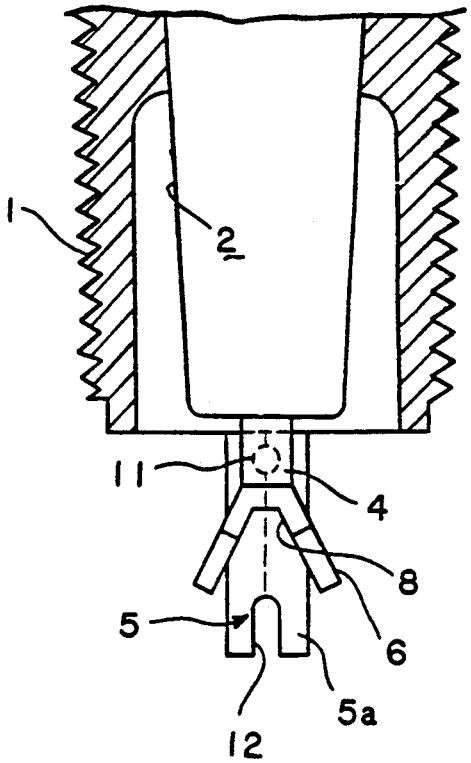
Figure 17:
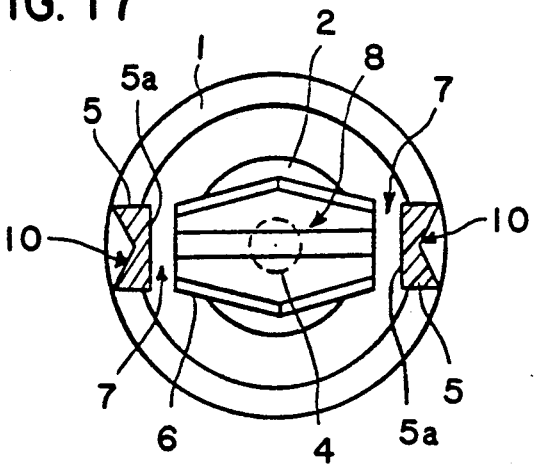

FIGS. 15 through 17 show the sixth example of an ignition plug of this invention. A saddle roof form ignition member 6 of which the skirt is V-shape and of which the re-entrant cavity 8 is open toward the piston side A is mounted on the top of a center electrode 4. A straight ground electrode 5, of which the inside surface 5a is flat and of which the outside surface is notched into a V-shaped groove 10, is disposed in pairs on both longitudinal sides the saddle-type ignition member 6 with a spark gap 7 in between so that the flat inside surface 5a of the ground electrode 5 is opposed to the longitudinal end of the saddle-type ignition member 6. A hole 11 and an inverted U-shaped notch 12 are provided to each of the ground electodes 5. The ignition plug is structured in such a way that first ignited gases appearing in the spark gap 7 travel not only to the cavity 8 under the ignition member 6 but also to the V-shaped groove 10 on the outside surface of the ground electrodes 5 passing through the hole 11 and the notch 12 so as to set gas mixture on fire instantaneously outside as well.

Figure 18:
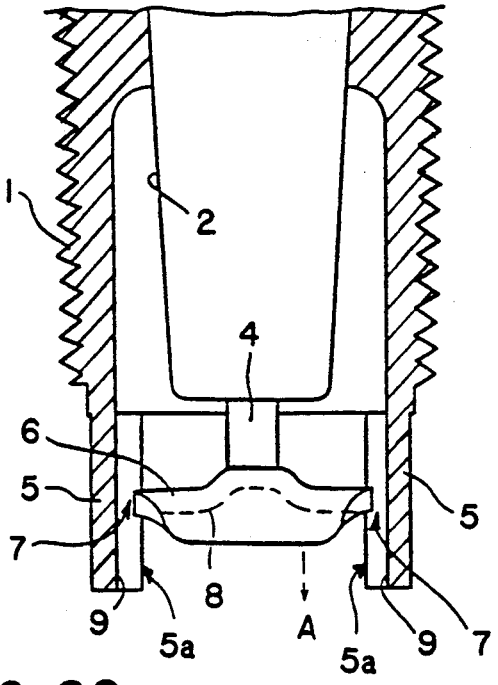
FIGS. 18 through 20 are an elevational view, a side view, and a bottom view of the seventh example of an ignition plug of this invention.
Figure 19:
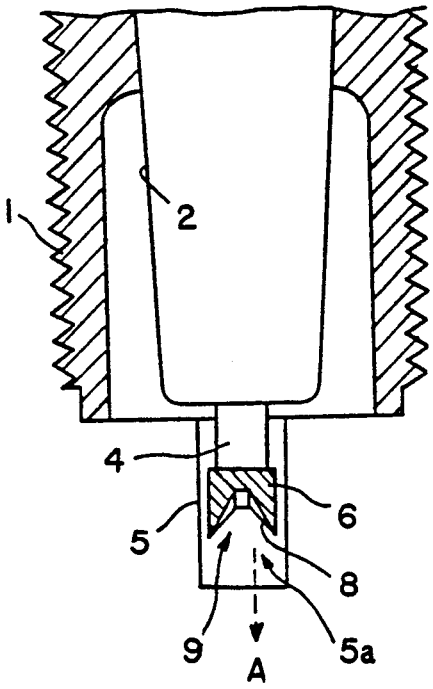
Figure 20:
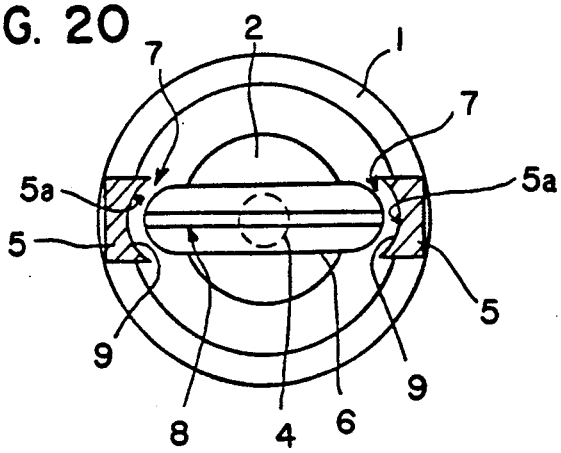

FIGS. 18 through 20 show the seventh example of an ignition plug of this invention. The middle portion of a rod-type ignition member 6 with which the same ignition member is mounted on the top of a center electrode 4 is bulged a little toward the center electrode, where the depth of a V-shaped groove 8 is made a little great as much; therefore, gas mixture can be contained much more in the middle portion of the ignition member 6 than in other portions thereof. The inside surface 5a of a ground electrode 5 is notched into a semicircular groove 9, which is opposed to the circular end of the circular end of the ignition member 6 with a spark gap 7 in between, as shown in FIG. 20. The structure of the ignition plug is such that the combustion of gas mixture is sharply strengthened toward the final stage thereof and the formation of first ignition seeds is improved by virtue of the spark gap 7 formed between the circular end of the ignition member 6 and the circularly concaved groove 9 of the ground electrode 5 parallel to each other.

Figure 21:
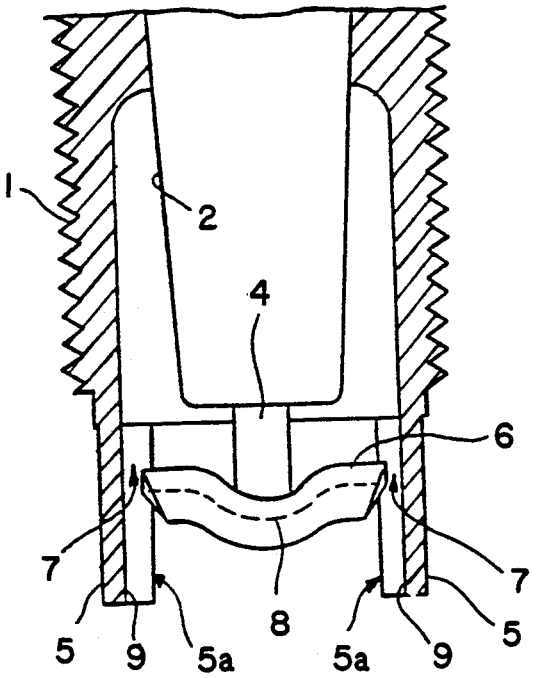
FIG. 21 through 23 are an elevational view, a side view, and a bottom view of the eighth example of an ignition plug of this invention.
Figure 22:
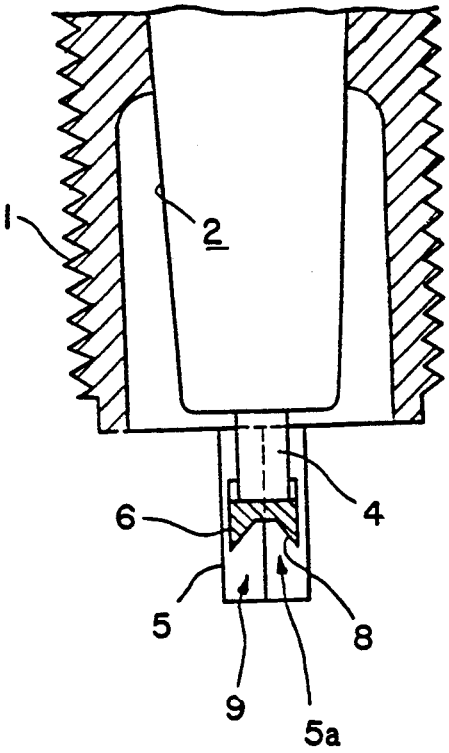
Figure 23:
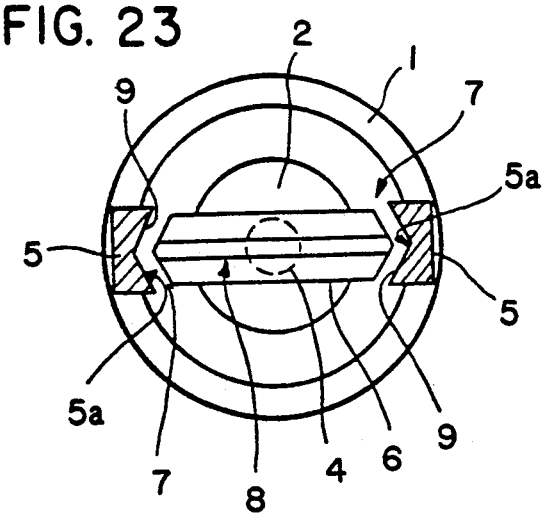

FIGS. 21 through 23 show the eighth example of an ignition plug of this invention. The middle portion of a rod-type ignition member 6 with which the same ignition member is mounted on the top of a center electrode 4 is dented a little toward the center electrode 4, where an ignition groove 8 is bulged as much toward the piston side A; therefore, the bottom of the ignition groove 8 slopes down from the center to both the ends. The inside surface 5a of a ground electrode 5 is notched into a V-shaped groove 9, which is opposed to the V-shaped end of the rod-type ignition member 6 with a spark gap 7 in between, as shown in FIG. 23. The structure of the ignition plug is such that the formation of first ignited gases is improved by virtue of the spark gap 7 formed between the V-shaped end of the ignition member 6 and the V-shaped groove 9 parallel to each other, and this allows combustion gas to widen toward the piston side A.

Figure 24:
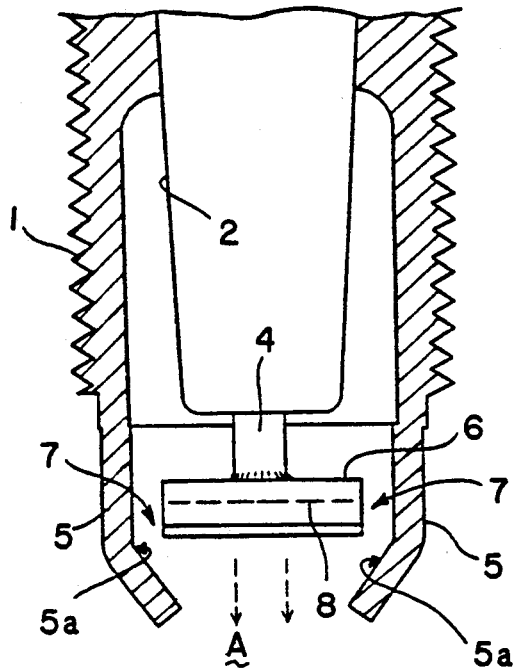
FIGS. 24 through 26 are an elevational view, a side view, and a bottom view of the ninth example of an ignition plug of this invention.
Figure 25:
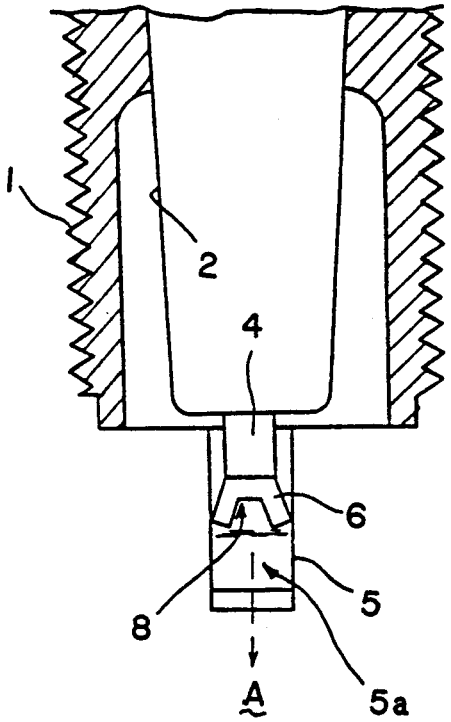
Figure 26:
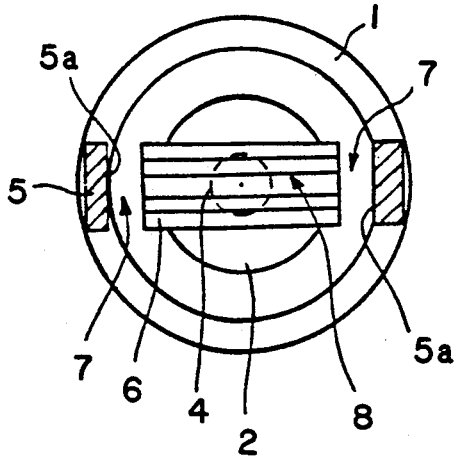

FIGS. 24 through 26 show the ninth example of an ignition plug of this invention. Both the lower ends of paired ground electrodes 5 are inwardly bent toward the axis of a center electrode 4; therefore, a rod-type ignition member 6 with a trapezoidal cross-sectioned ignition groove 8 made out of plate metal looks like being held by the ground electrodes 5 on both sides thereof, as shown in FIG. 24.

Such is the structure of the ignition plug that ignited gases appearing in a spark gap 7 impinge on the inside surface 5a of both the ground electrodes 5 and jump into the ignition groove 8, whereby the ignition time from the appearance of first ignited gases to that of second ones on the ignition groove 8 is reduced very much and the ignition effect is strengthened.

Figure 27:
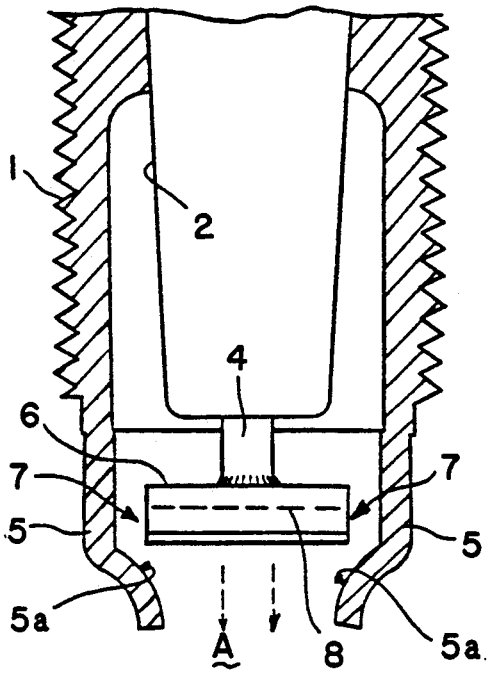
FIGS. 27 through 29 are an elevational view, a side view, and a bottom view of the tenth example of an ignition plug of this invention.
Figure 28:
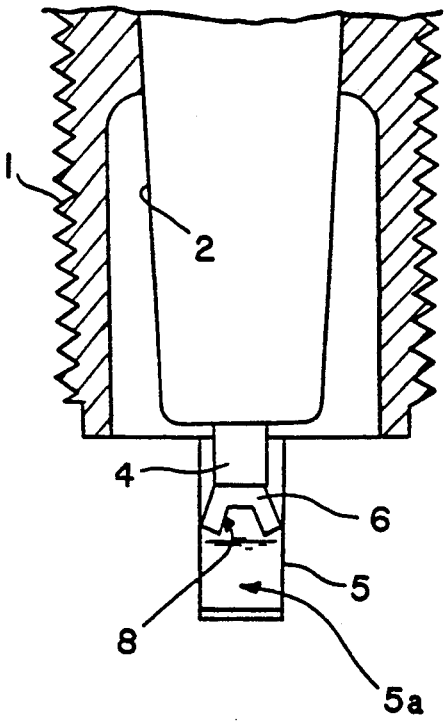
Figure 29:
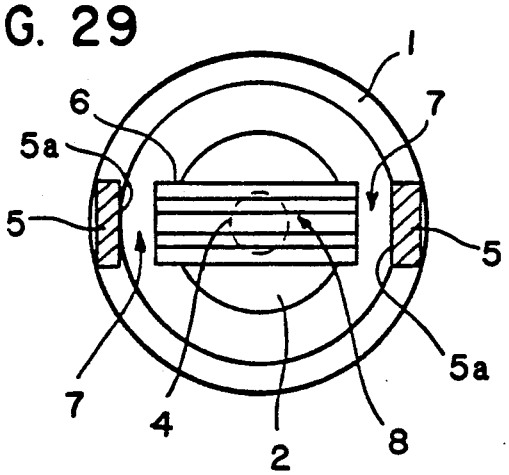

FIGS. 27 through 29 show the tenth example of an ignition plug of this invention. Both the ends of paired ground electrodes 5 are inwardly and convexly bent toward the axis of a center electrode 4; thus, ignited gases appearing in a spark gap 7 strike on the inside surface of the ground electrodes 5 and radiantly bounce thereon before jumping into a trapezoidal cross-sectioned platemetal-made ignition groove 8 of a rod-type ignition member 6. Therefore, it is sure that second ignited gases appear more uniformly on the ignition groove 8 extending the whole length thereof.

Figure 31:
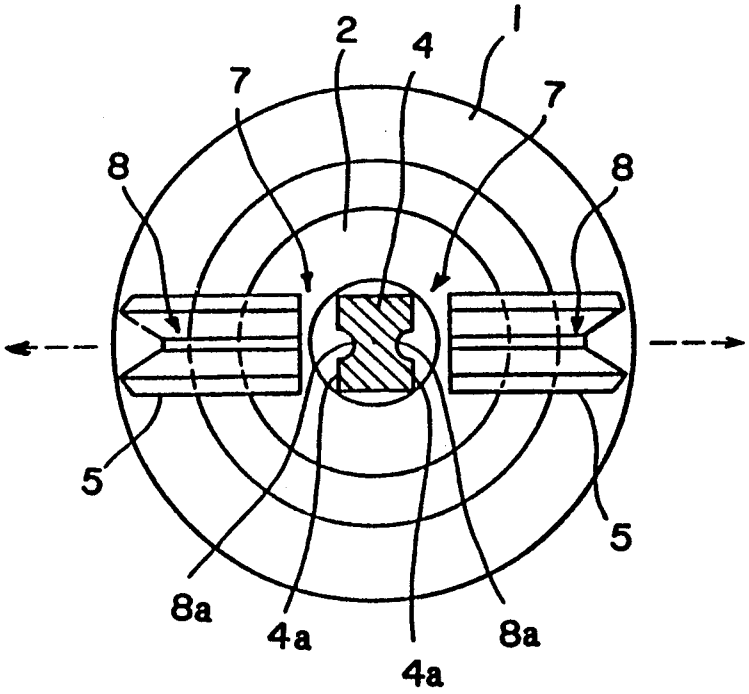
FIGS. 30 and 31 are an elevational view and a bottom view of the eleventh example of an ignition plug of this invention.
Figure 30:
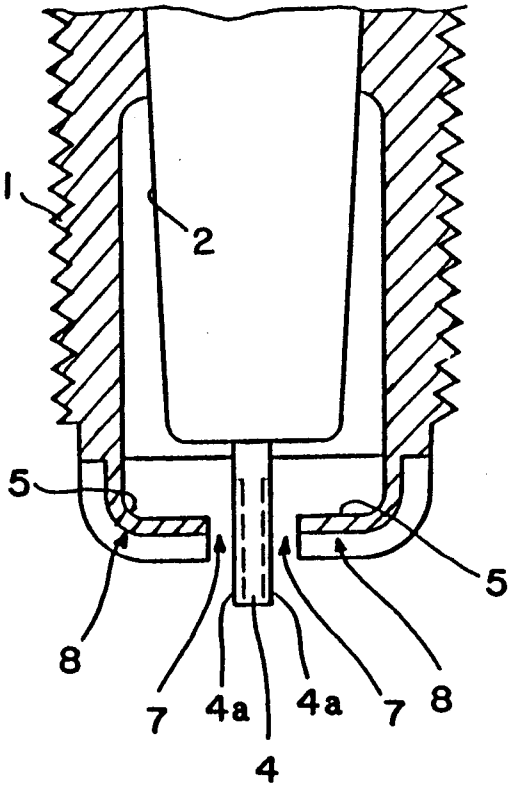

FIGS. 30 and 31 show the eleventh example of an ignition plug of this invention. The flat surface 4a of a center electrode 4 facing a spark gap 7 is notched into a semicircular cross-sectioned groove 8a. On the other hand, the outside surface of paired L-shaped ground electrodes 5 on the piston side A is notched into a trapezoidal cross-sectioned groove 8. Thus, there forms a spark gap 7 between the flat side surface of the center electrode 4 and the free end of the groove 8 opposed to the center electrode 4. The structure of the ignition plug is such that, when first ignition seeds appear in the spark gap 7, their expanding combustion gas strikes the flat surface 4a of the center electrode 4, and ignited gases jump into the ignition groove 8 of the ground electrode 5 by repulsion, which multiplies second ignited gases on the groove 8 and reduces the time before combustion. Also, since first ignited gases appearing in the spark gap 7 concurrently reach the groove 8a on the center electrode 4, the effect of their expanding combustion is added to the effect of their repulsion on the flat surface 4a, which helps the ignition travel from the spark gap 7 to the groove 8 much more rapidly.

Figure 33:
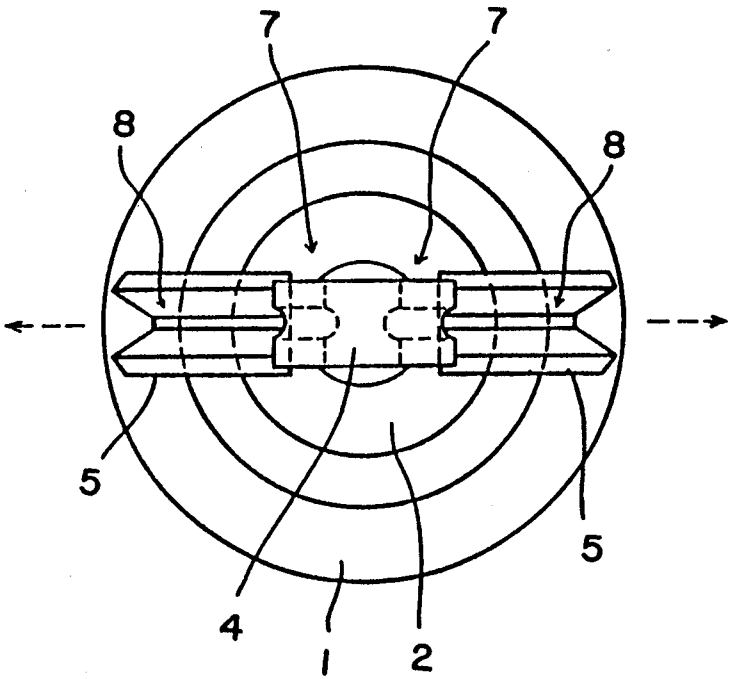
FIGS. 32 and 33 are an elevational view and a bottom view of the twelfth example of an ignition plug of this invention.
Figure 32:
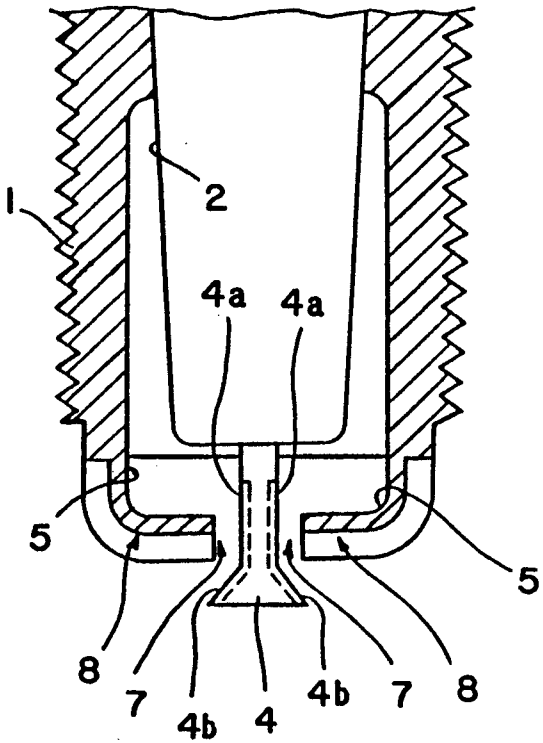

FIGS. 32 and 33 show the twelfth example of an ignition plug of this invention. The thickness of a center electrode 4, which defines the distance between both the flat side surfaces 4a of the center electrode 4, is increased from the outside of a spark gap 7 in such a way as to form a bulging guide plane 4b there. The form of the center electrode 4 is such that, when first, ignited gases form in the spark gap 7, their expanding combustion gas strikes on the flat portion 4a of the center electrode 4, and drives ignited gases so as to jump into an ignition groove 8 of a ground electrode 5 taking advantage of the guide plane 4b; thus, this system not only multiplies second ignition seeds on the groove 8 but also reduces the time before combustion much more than in the preceding example.

Figure 34:
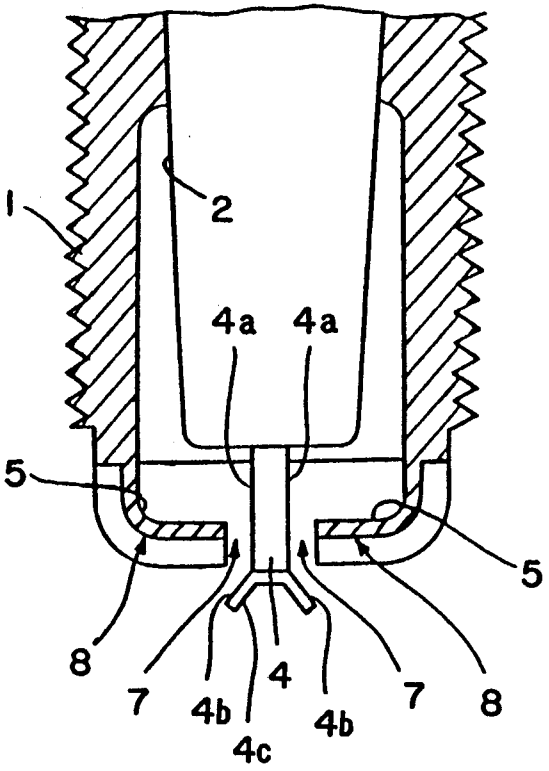
FIGS. 34 is an elevational view of the thirteenth example of an ignition plug of this invention.

FIG. 34 shows the thirteenth example of an ignition plug of this invention. In stead of the bulging guide plane 4b being made out of a solid metal center electrode 4, a roof form trapezoidal cross-sectioned guide 4c, which can be processed more readily from plate metal, is mounted on the top of the center electrode 4. The action and the effect of the ignition plug is almost the same as those of the preceding example 12.

Figure 35:
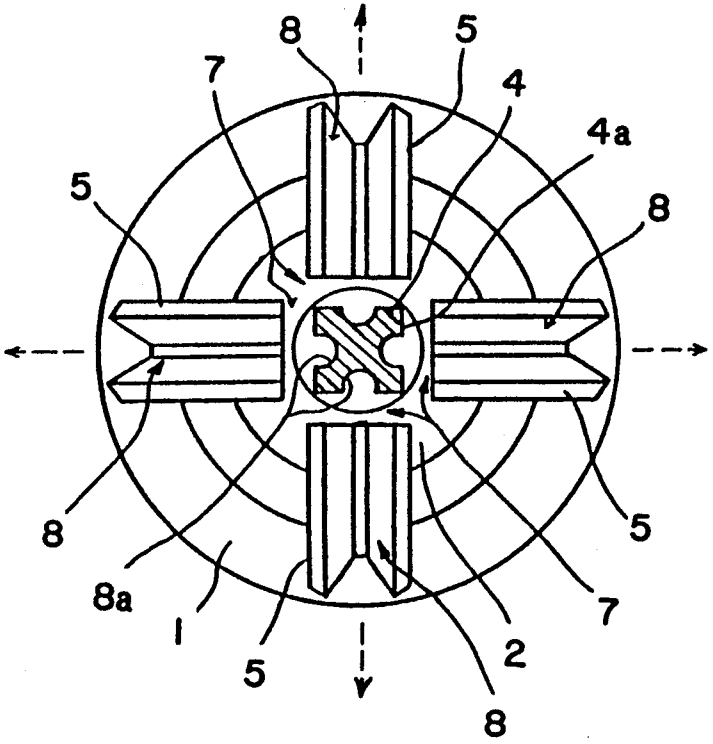
FIG. 35 is a bottom view of the fourteenth example of an ignition plug of this invention.

FIG. 35 shows the fourteenth example of an ignition plug of this invention. Whereas example 11 is provided with a pair of ground electrodes 5 symmetrically on both sides of the center electrode 4, this example is provided with four pieces of L-shaped ground electrodes 5 at an angular interval of about 90° on the same circumference around the center electrode 4 with a spark gap 7 in between respectively. Therefore, the free end of an ignition groove 8 on each outside surface of the ground electrodes 5 is opposed to a groove 8*a* on every flat side surface of the square cross-sectioned center electrode 4, which improves the durability of the ground electrodes 5 against scorching due to overheating.

Figure 37:
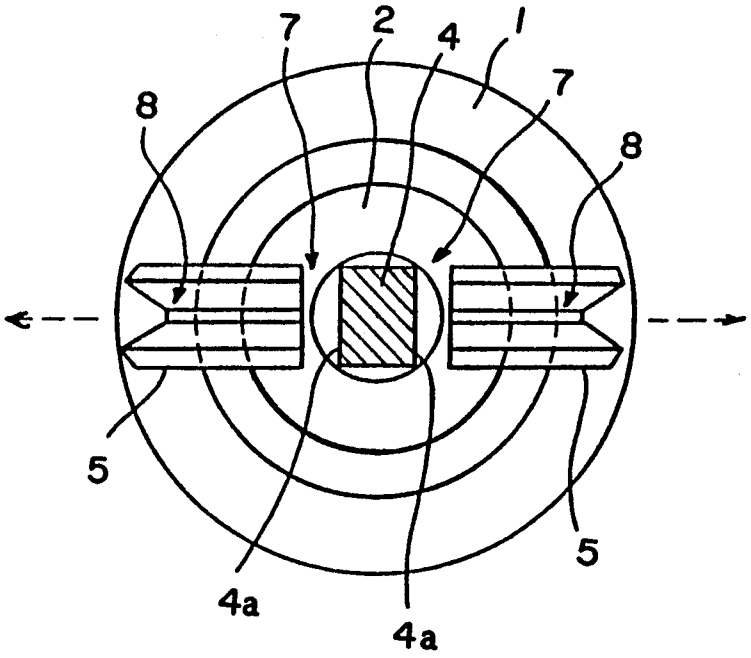
FIGS. 36 and 37 are an elevational view and a bottom view of the fifteenth example of an ignition plug of this invention.
Figure 36:
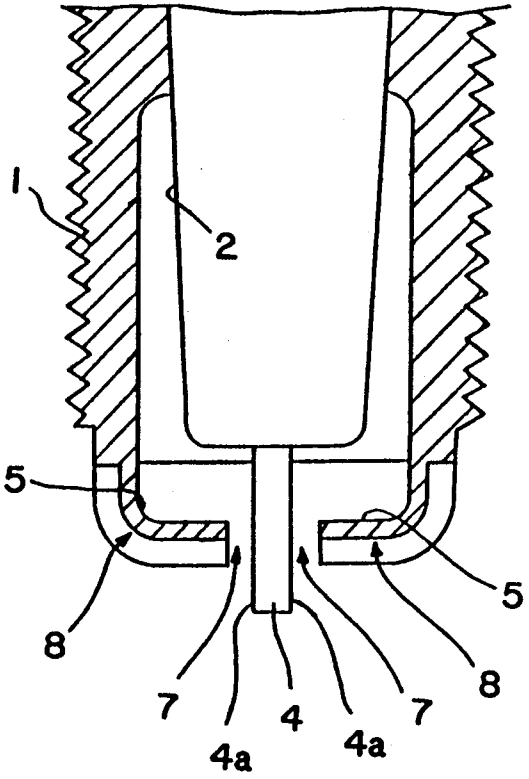
Figure 42:
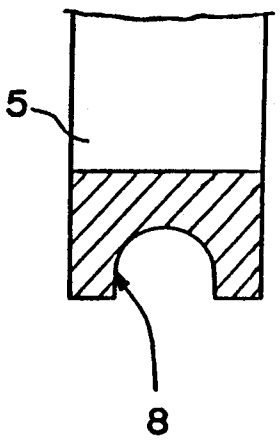
FIGS. 38 through 42 are an illustration showing a variety of modifications of cross sections of an ignition groove used in this invention.
Figure 41:
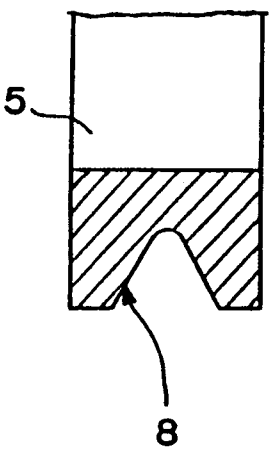
Figure 40:
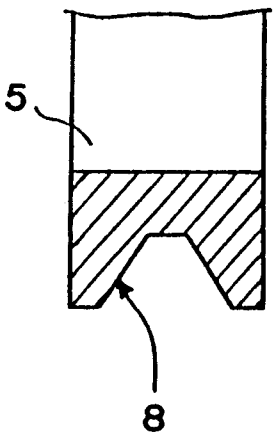

In the meantime, the groove 8*a*, provided to the flat side surface 4*a* of a center electrode 4, may be omitted like in the fifteenth example of this invention whose structure is shown in FIGS. 36 and 37.

Figure 39:
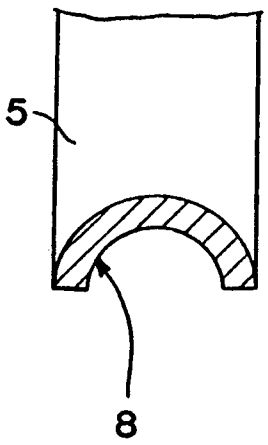
Figure 38:
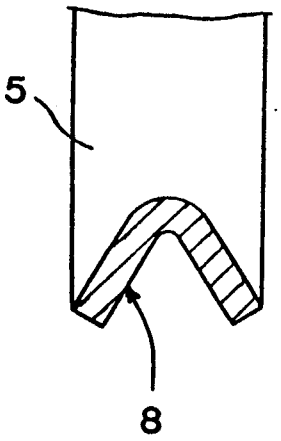

FIGS. 38 through 42 show a variety of modifications of cross-sections of an ignition groove 8. Like in example 11, an ignition groove 8 with trapezoidal cross-section can be made on a solid ground electrode 5. But as shown in FIGS. 38 and 39, the cross section of an ignition groove 8 can be made in a V- or semicircular shape by bending plate metal, and this facilitates commercial production much more. Additionally, when a square cross-sectioned solid electrode is made use of, it can be notched into a trapeziodal, V-, or semicircular shaped groove by machining, if necessary.

As already stated above, in an ignition plug of this invention, the structure of which is shown in FIGS. 2 through 29, in which a spark gap 7 lies between the inside surface 5*a* of a ground electrode 5 and the end of an ignition member 6 mounted on the top of a center electrode 4, ignition seeds first appearing in the spark gap, as they develop into a large volume of combustion gas, strike successively forming ignition seeds against the inside surface of the ground electrode in such a way as to jump into a groove 8 on the ignition member 6, taking advantage of their bouncing on the inside surface of the ground electrode, and form much more second ignited gases there; therefore, lots of the second ignited gases thus formed can accelerate complete combustion over the entire space of the ignition plug and reduce the time from the appearance of first ignition seeds to the completion of combustion.

Also, in the other ignition plug of this invention, the structure of which is shown in FIGS. 30 through 37, in which a spark gap 7 lies between the flat side surface of a center electrode 4 and the end of an L-shaped ground electrode 5 opposed thereto, ignited gases first appearing in the spark gap 7, as they develop into a large volume of combustion gas, strike successively forming ignition seeds against the flat side surface of the center electrode 4 in such a way as to jump into a groove 8 on the outside of the ground electrode 5 taking advantage of their bouncing on the side surface of the center electrode 4 and form much more second ignited gases there. Therefore, lots of the second ignited gases thus formed can accelerate complete combustion over the entire space of the ignition plug, and reduce the time from the appearance of first ignition seeds to the completion of combustion.

In connection with the commercial production, an ignition groove provided to an ignition member, the side surface of a ground electrode, or the outside surface of a ground electrode can be shaped into various forms: square, rectangular, trapezoidal, V, U, semicircular, and so forth by notching solid rod-type metal or by folding plate metal, in one piece with or separately from an ignition member, center or ground electrode, according to the circumstances. In any case, according to this invention, an ignition plug for internal combustion engines can be manufactured in a very simple structure with excellent capacity, which cuts down on the production cost, as well as economizes the fuel consumption greatly.

What the present inventors claim is:

1. An ignition plug for an internal combustion engine comprising;

(a) an insulating body;

(b) a high tension center electrode positioned axially within the body and having an axial end;

(c) an ignition member fixed to the axial end of said center electrode, said ignition member having at least one end facing radially outward from the center electrode and a groove having a longitudinal axis, said groove facing axially away from the center electrode;

(d) at least one ground electrode radially spaced from the end of the ignition member on the center electrode and positioned along the longitudinal axis of said groove to define a spark gap between the ground electrode and the end of the ignition device;

whereby a gas mixture can be ignited by a spark between the end of the ignition member and the ground electrode and whereby expanding combustion gases impinge against the ground electrode and are diverted along the longitudinal axis of the groove.

2. An ignition plug as claimed in claim 1 wherein said ignition member is an elongated rod-shaped member having two opposing ends facing radially outward from the center electrode, and wherein two ground electrodes are spaced from the ends of the ignition member to define a spark gap between each end of the ignition member and the ground electrodes, each of said ground electrodes having a substantially flat side surface facing the ends of the ignition member.

3. An ignition plug as claimed in claim 1 wherein said ignition member is substantially y-shaped member having three arms extending radially outward at an angle of about 120° from an adjacent arm, each arm having a longitudinal groove facing axially away from the center electrode and an end facing radially outward from the center electrode, and wherein three ground electrodes are spaced from the ends of each of the arms of the ignition member to define a spark gap between the end of the ignition member and the ground electrodes, each of said ground electrodes having substantially flat side surface facing the ends of the ignition member.

4. An ignition plug as claimed in claim 1 wherein said ignition member has four arms extending radially outward at an angle of 90° to each other, each of said arms having longitudinal groove facing axially outward from the center electrode and an end facing radially outward from the center electrode, and wherein four ground electrodes are spaced from the ends of the arms of the ignition member to define a spark gap between the end of the ignition member and the ground electrodes, each of said ground electrodes having a substantially flat side surface facing the ends of the ignition member.

5. An ignition plug as claimed in claim 2, wherein the ground electrodes have an end inwardly bent toward an axis of said center electrode whereby the end of the ground electrode encircle the center electrode.

6. An ignition plug as claimed in claim 5, wherein the end of said ground electrode is inwardly bent toward the axis of said center electrode to define a depending skirt, and wherein said skirt is convex with respect to the center electrode.

7. An ignition plug as claimed in claim 1, wherein said ignition member is an elongated member having a substantially V-shaped cross section and a pair of outwardly diverging skirts, said skirts having a semicircular shape, and wherein two ground electrodes are provided and spaced from ends of said ignition member, each of said ground electrodes having a surface facing the ignition member and defining a spark gap there between.

8. An ignition plug as claimed in claim 1, wherein a portion of said longitudinal groove in said ignition member is recessed toward said center electrode defining a cavity in said ignition groove whereby a combustible gas mixture is retained during ignition to promote combustion of a gas mixture.

9. An ignition plug as claimed in claim 1, wherein a portion of said ignition member adjacent said center electrode has a substantially convex portion projecting axially from the center electrode thereby forming a bulge portion in said ignition groove whereby combustion gases are directed outwardly from the center electrode.

10. An ignition plug as claimed in claim 7, wherein an outside surface of said ground electrodes opposite said center electrode is provided with an axially disposed longitudinal groove, and wherein said ground electrodes further include a hole adjacent said center electrode and a U-shaped notch in the end of the ground electrode.

11. An ignition plug as claimed in claims 8 or 9, wherein an inside surface of said ground electrodes is provided with a longitudinal groove having a cross sectional shape corresponding to the shape of the end of said ignition member thereby forming a spark gap of constant width between the ground electrode and the ignition member.

12. An ignition plug for internal combustion engines, said plug having a spark gap defined by opposing center and at least one ground electrode spaced radially outward from the center electrode, wherein said center electrode includes at least one flat surface opposing said ground electrode, and wherein an outside surface of said ground electrode is provided with an axially disposed longitudinal groove, said ground electrode having a substantially L-shape defining a first leg disposed substantially parallel to the center electrode and a second leg extending toward said center electrode, said second leg having an end opposing said flat surface of said center electrode.

13. An ignition plug as claimed in claim 12, wherein each flat surface of said center electrode opposing said ground electrode is provided with a longitudinal groove.

14. An ignition plug as claimed in claim 13, wherein said center electrode includes a pair of outwardly diverging skirts for guiding combustion gas.

15. An ignition plug as claimed in claim 14, in which said guide skirt is made of folded plate metal or from an engraved solid metal rod.

16. An ignition plug as claimed in any one of claims 10 or 12 through 15 in which the cross-section of said groove on the surface of said ground electrode is a square, rectangular, semicircular, trapezoidal, V-, or U-shape, and said groove is made from a folded metal plate or from an engraved solid metal rod.

17. An ignition plug as claimed in any one of claims 12 through 15, in which the cross-section of said ignition groove on the side surface of said center electrode is a square, rectangular, semicircular, trapezoidal, V-, or U-shape, and said groove is made from a folded metal plate or engraved solid metal rod.

18. A process for igniting a gas mixture in an internal combustion engine using an ignition plug, wherein said plug includes (a) an insulating ceramic body;
(b) a high tension center electrode positioned within the ceramic body;
(c) an ignition member fixed to the center electrode, said ignition member having at least one radially facing end and outwardly facing groove having a longitudinal axis;
(d) at least one ground electrode radially spaced from the ignition member of the center electrode and positioned along the longitudinal axis of the groove to define a spark gap between the ground electrode and the end of the ignition device;

said method comprising igniting a gas mixture in said spark gap whereby combustion gases impinge against the ground electrode and diverting the ignited gases along the longitudinal axis of the groove and igniting gas mixtures present in said groove.

19. A process for igniting a gas mixture in an internal combustion engine using an ignition plug, wherein said plug includes (a) an insulating ceramic body;
(b) a high tension center electrode positioned within the ceramic body and having at least one flat face facing radially outward;
(c) at least one ground electrode radially spaced from the ignition member of the center electrode and positioned opposite the flat face of the center electrode, said ground electrode having a radially outwardly facing longitudinal groove, a spark gap being defined between the ground electrode and the end of the ignition device;

said method comprising igniting a gas mixture in said spark gap whereby combustion gases impinge against the center electrode and diverting the ignited gases along the longitudinal axis of the groove of the ground electrode and igniting gas mixtures present in said groove.

* * * * *